US007090340B2

(12) United States Patent
Tobita et al.

(10) Patent No.: US 7,090,340 B2
(45) Date of Patent: Aug. 15, 2006

(54) INKJET RECORDING HEAD AND INKJET RECORDING APPARATUS USING THE SAME

(75) Inventors: Satoru Tobita, Ibaraki (JP); Yoshitaka Akiyama, Ibaraki (JP); Toshiharu Sumiya, Ibaraki (JP); Yoshikane Matsumoto, Ibaraki (JP)

(73) Assignee: Hitachi Printing Solutions, Ltd., Tokyo (JP)

( * ) Notice: Subject to any disclaimer, the term of this patent is extended or adjusted under 35 U.S.C. 154(b) by 154 days.

(21) Appl. No.: 10/725,379

(22) Filed: Dec. 3, 2003

(65) Prior Publication Data

US 2004/0109047 A1 Jun. 10, 2004

(30) Foreign Application Priority Data

Dec. 4, 2002 (JP) ..... P.2002-352127

(51) Int. Cl.
*B41J 2/045* (2006.01)
*B41J 2/05* (2006.01)

(52) U.S. Cl. ..... 347/68; 347/65

(58) Field of Classification Search ..... 347/68, 347/70, 72, 65; 29/25, 35
See application file for complete search history.

(56) References Cited

U.S. PATENT DOCUMENTS 5,604,522 A * 2/1997 Miura et al. ..... 347/70
5,710,584 A * 1/1998 Suzuki et al. ..... 347/70
6,089,701 A * 7/2000 Hashizume et al. ..... 347/70

FOREIGN PATENT DOCUMENTS

JP 6-8422 1/1994
JP 8-11304 1/1996
JP 2000-289233 10/2000

* cited by examiner

*Primary Examiner*—Shih-Wen Hsieh
(74) *Attorney, Agent, or Firm*—McGinn IP Law Group, PLLC

(57) ABSTRACT

An inkjet recording head includes: a nozzle plate having nozzles arranged in a row; a plurality of pressure generating chambers communicating to the nozzles, the plurality of pressure generating chambers including a first pressure generating chamber and a second pressure generating chamber; a diaphragm formed on one face of the pressure generating chamber; a common ink chamber for supplying the ink to the plurality of pressure generating chambers; and a piezoelectric element for displacing the diaphragm. The first pressure generating chamber is disposed on one side of the nozzles and a second pressure generating chamber is disposed on the other side. The first and second pressure generating chambers are opposed to each other across the nozzles so that the central lines of the first and second pressure generating chambers are almost coincident.

16 Claims, 5 Drawing Sheets

INKJET RECORDING HEAD AND INKJET RECORDING APPARATUS USING THE SAME

BACKGROUND OF THE INVENTION

1. Field of the Invention

The present invention relates to an inkjet recording head that can be packaged at high density and an inkjet recording apparatus using the inkjet recording head.

2. Background Art

Along with the spread of personal computers and the development of graphic processing programs, there is a demand for outputting not only the characters but also the hard copy with high quality of image. Also, there is a great demand for on-demand printing in the placard or large poster printing field, whereby the on-demand inkjet recording apparatus has been broadly used.

A printing head for use in the on-demand inkjet recording apparatus is largely classified into three kinds of structures. A first structure is a so-called thermal inkjet printing head in which a heater for vaporizing the ink instantaneously is provided at the top end of nozzle to produce flying ink droplets owing to an expansion pressure at the time of vaporization.

A second structure involves using a shear mode deformation of piezoelectric element in which a piezoelectric element is provided in a container forming an ink reservoir to produce flying ink droplets owing to a pressure caused when the piezoelectric element is deformed upon an applied signal.

A third structure involves using an electrostatic adsorption, instead of a piezoelectric vibrator, in which a piezoelectric element is disposed opposed to a pressure generating chamber making an ink reservoir to produce flying ink droplets owing to a dynamic pressure caused in the pressure generating chamber by expansion and contraction of the piezoelectric element.

In JP-A-6-8422, one example of the on-demand inkjet recording head of the third type was disclosed. This third structure involves flying ink droplets by using a deformation of piezoelectric element in which piezoelectric elements are packaged opposed to an ink chamber composed of a plurality of chamber plates laminated, a chamber plate having a plurality of nozzle openings arranged in a row. In the case of this recording head, there is a problem that if the nozzle packaging density, or a so-called nozzle-to-nozzle pitch interval, is decreased, the pitch of the ink chamber or the piezoelectric element is naturally smaller.

To solve this problem, JP-A-2000-289233 has proposed a method in which a plurality of rows of nozzles are arranged within one head, and the nozzle positions in each row are shifted, thereby increasing the printing density in which data is printable per one scan.

However, with this method, since a plurality of rows of nozzles are formed in one plate, the piezoelectric vibrators must be packaged opposed to each row of nozzles.

As another conventional example with the increased packaging density of nozzles, a structure as shown in FIG. 12 is well known. This recording head comprises a nozzle plate 11 having a plurality of nozzle openings 16, and a chamber plate 12 with the pressure generating chambers 18 arranged in alternately staggered form, corresponding to the plurality of nozzle openings 16 arranged on the nozzle plate 11, in which the piezoelectric elements 23 divided like a comb are securely disposed opposed to the pressure generating chambers 18 sealed with a diaphragm 13.

In this constitution, since the pressure generating chambers 18 are disposed in staggered form, the corresponding piezoelectric elements 23 are also disposed in staggered form. That is, since two groups of piezoelectric elements must be precisely inserted and secured at very proximate positions, there is a problem that the operability of assembling is bad.

In packaging the nozzles of the inkjet recording head at high density to increase the number of nozzles, it is necessary to enhance the workability and the operability of assembling. If the number of parts or aligning positions is increased, the precision is lowered, making it difficult to fabricate the high quality inkjet recording head stably.

The structure in which a plurality of row of nozzles are arranged on one plate to attain a higher packaging density has a problem that a group of vibrators are required for each row of nozzles, and there are a number of aligning positions, resulting in the bad workability and the higher cost. Also, since the printing occurs only in the direction along which the plurality of rows of nozzles are arranged, the line recording apparatus of head fixed type has only a packaging structure in which the heads are arranged in staggered form. Also, it is difficult to avoid a problem that the area of head portion is so large that a head preservation portion or the entire apparatus is increased in size.

The conventional example as shown in FIG. 12 has a problem that the workability is bad, because it is required to shift and fix two groups of piezoelectric elements in a very narrow area at high precision.

SUMMARY OF THE INVENTION

It is an object of the present invention to provide an inkjet recording head and an inkjet recording apparatus using the inkjet recording head without the above-mentioned problems.

More specifically, it is another object of the invention to provide an inkjet recording head and an inkjet recording apparatus using the inkjet recording head having a structure in which a plurality of nozzles are packaged in an ink chamber efficiently, with the excellent operability of assembling.

To achieve the objects, the invention provides an inkjet recording head including: a nozzle plate having nozzles for discharging ink droplets arranged in a row; a plurality of pressure generating chambers communicating to the nozzles, the plurality of pressure generating chambers including a first pressure generating chamber and a second pressure generating chamber; a diaphragm formed on one face of the pressure generating chamber; a common ink chamber for supplying the ink via an ink supply passage to the plurality of pressure generating chambers; and a piezoelectric element for displacing the diaphragm; wherein the first pressure generating chamber is disposed on one side of the nozzles arranged in the row, and a second pressure generating chamber is disposed on the other side; and the first and second pressure generating chambers are opposed to each other across the nozzles arranged in the row so that the central lines of the first and second pressure generating chambers are almost coincident.

Further, the invention may provide an inkjet recording apparatus including: a nozzle plate having nozzles for discharging ink droplets arranged in a row; a plurality of pressure generating chambers communicating to the nozzles, the plurality of pressure generating chambers including a first pressure generating chamber and a second pressure generating chamber; a diaphragm formed on one face of the pressure generating chamber; a common ink chamber for supplying the ink via an ink supply passage to the plurality of pressure generating chambers; and a piezoelectric element for displacing the diaphragm; wherein the first pressure generating chamber is disposed on one side of the nozzles arranged in the row, and a second pressure generating chamber is disposed on the other side; and the first and second pressure generating chambers are opposed to each other across the nozzles arranged in the row so that the central lines of the first and second pressure generating chambers are almost coincident.

BRIEF DESCRIPTION OF THE DRAWINGS

The present invention may be more readily described with reference to the accompanying drawings.

DETAILED DESCRIPTION OF THE PREFERRED EMBODIMENTS

Figure 1:
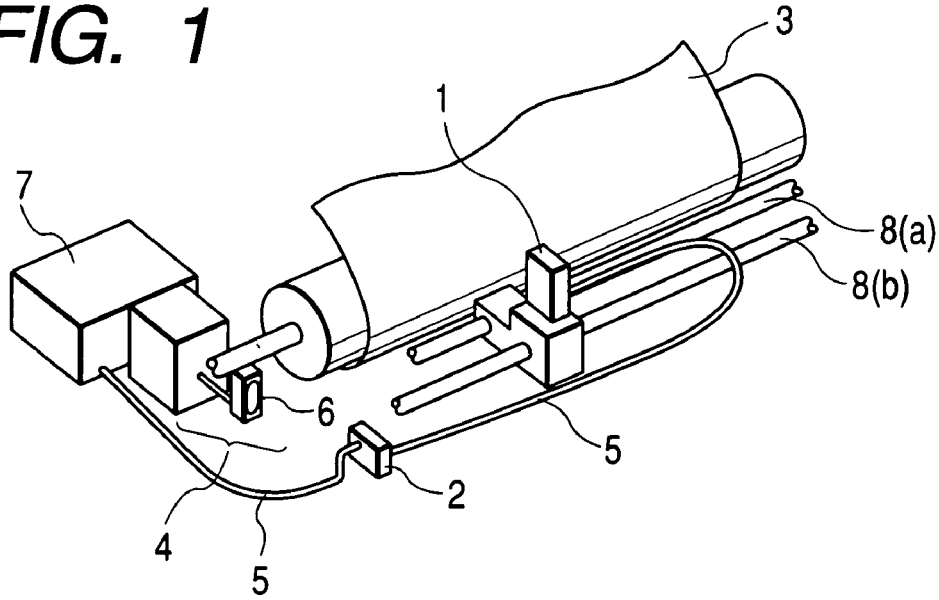
FIG. 1 is a schematic view showing one example of an inkjet recording apparatus having an inkjet recording head mounted according to the present invention.

FIG. 1 shows an inkjet recording apparatus according to one embodiment of the invention. This embodiment involves a serial scan printing system, but the invention is also applicable to a line printing system with a head fixed. The inkjet recording head of the invention may be also utilized as an industrial dispenser or a three-dimensional molding machine, besides the printing apparatus.

In FIG. 1, 1 denotes an inkjet recording head, 2 denotes a sub-ink tank, 3 denotes the printing paper, and 4 denotes a head preserving portion. The head 1 prints the characters or graphics by discharging ink droplets onto the printing paper while reciprocating along the guide shafts 8(*a*) and 8(*b*).

The ink is fed from a main ink tank 7 through a supply tube 5 to a sub-ink tank 2, and further through the supply tube 5 to the head 1. The head preserving portion 4 has a cap 6 for preventing the ink of the nozzles from drying or the alien matter from adhering when the head 1 is not in use. Also, a wiper blade, though not shown in the figure, is disposed for wiping away the ink adhering to the nozzle face. The cap 6 is also employed as a suction cap in refilling the ink from the sub-ink tank 2 in the head 1 or performing a purge operation to remove air bubbles stagnant in the head 1.

Figure 2:
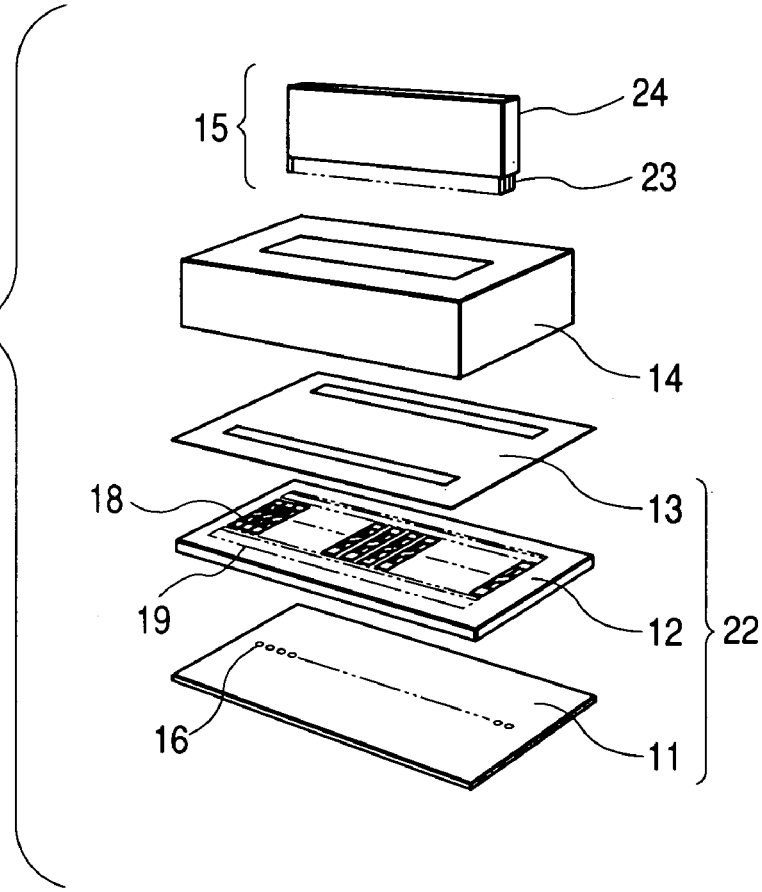
FIG. 2 is a view showing the parts of the inkjet recording head according to the invention.
Figure 3:
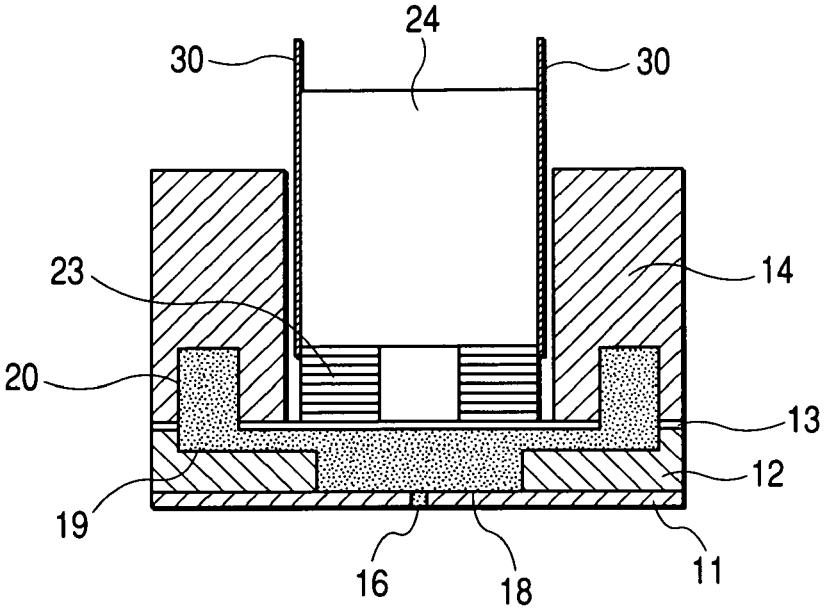
FIG. 3 is a partial cross-sectional view showing one example of the ink jet recording head according to the invention.

The details of the recording head 1 according to the invention will be described below. FIG. 2 is a view showing the parts of the head 1 in the inkjet recording apparatus according to the invention. FIG. 3 is a partial cross-sectional view of the head 1.

The head 1 comprises a piezoelectric element group 15, an ink flow passage board 22, and a housing 14 having high rigidity for fixing the board 22.

The ink flow passage board 22 comprises a diaphragm 13, a chamber plate 12 and a nozzle plate 11. The nozzle plate 11 has arranged a plurality of nozzle openings 16 for discharging ink droplets. The chamber plate 12 comprises a pressure generating chamber 18 communicating to the nozzle openings 16, a restrictor 17 (FIG. 4) serving as a flow passage for supplying the ink 20 to the pressure generating chamber 18, and a common ink chamber 19 connected to the restrictor 17, which are disposed oppositely around the nozzle opening portion 16. The diaphragm 13 having elasticity is formed on one wall face of the pressure generating chamber 18, and owing to its vibration, the volume of the pressure generating chamber 18 is easily changed.

The piezoelectric element group 15 is composed of a piezoelectric element 23 and a base board 24. One end of the piezoelectric element 23 is fixed to the base board 24 and the other end is the diaphragm 13, so that the diaphragm 13 is displaced according to vibrations of the piezoelectric element 23.

Figure 5:
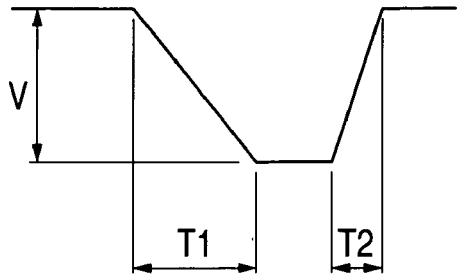
FIG. 5 is a waveform chart showing one example of a drive voltage of the recording head according to the invention.

A voltage V as shown in FIG. 5, for example, is applied to each piezoelectric element 23. The piezoelectric element contracts during the period T1 where the voltage falls, so that the volume of the pressure chamber 18 is expanded to cause the ink 20 to flow from the common ink chamber 19. Thereafter, at the timing at which an ink meniscus on the nozzle face 16 vibrates, the piezoelectric element is expanded during the period T2 where the voltage rises, causing the pressure chamber 18 to be contracted. Using its pressure, the ink is discharged from the ink openings 16.

Figure 4:
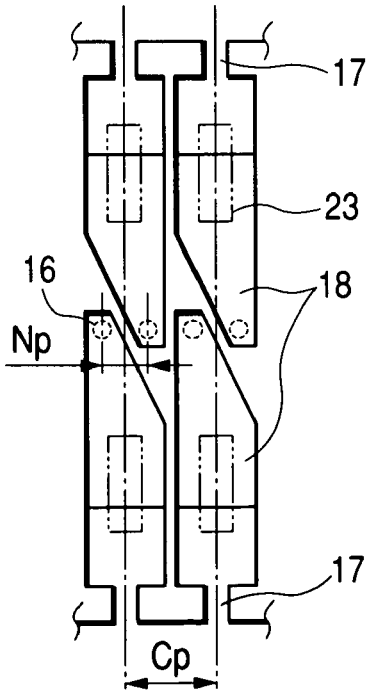
FIG. 4 is a partially enlarged view of a chamber plate making up the recording head according to the invention.

FIG. 4 is a partially enlarged plan view of the chamber plate 12.

Figure 12:
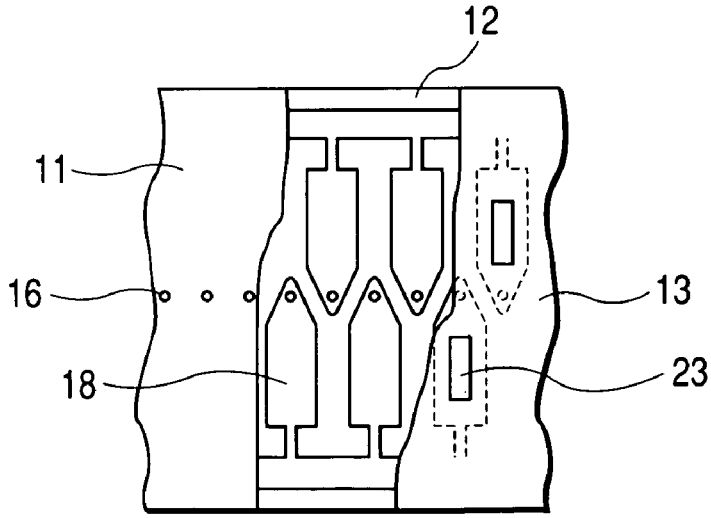
FIG. 12 is a schematic view showing an ink flow passage board making up the conventional recording head.

As will be apparent from the figure, the pressure generating chambers 18 are oppositely disposed on both sides of the nozzle openings 16 arranged in a row in this embodiment of the invention. That is, though the pressure generating chambers 18 are disposed in staggered form in the conventional example of FIG. 12, the pressure generating chambers 18 opposed on both sides of the row of nozzle openings 16 are disposed so that their central lines may be coincident in this example. Also, the ink flow passage composed of the pressure generating chamber 18 and the restrictor 17 is disposed so that its central line may pass through the almost intermediate position between the two adjacent nozzle openings 16. Accordingly, the piezoelectric element 23 connected to the position opposite to the pressure generating chamber 18 (as indicated by the two-dot chain line in FIG. 4) is disposed in the base board 24 to be opposed to the row of nozzles 16. Assuming that the pitch between pressure generating chambers, or the distance between the central lines of adjacent pressure generating chambers 18 is Cp, and the nozzle-to-nozzle pitch, or the distance between adjacent nozzles 16 is Np, Np=Cp/2.

Also, the ink flow passage communicating to the nozzle openings 16 is narrowed from the pressure generating chamber 18 to the nozzle openings 16, in which two nozzle openings 16 are disposed between the central lines of adjacent pressure generating chamber 13.And one nozzle opening is in communication to the pressure generating chamber 18 on one side of the row of nozzles, and the other nozzle opening is in communication to the pressure generating chamber 18 on the other side of the row of nozzles. This configuration has the advantage of securing the flow passage for adjacent nozzles from the opposed pressure generating chambers 18, and preventing the air bubbles from stagnating in the flow passage because the ink flow rate is increased in a narrowed portion.

Figure 6:
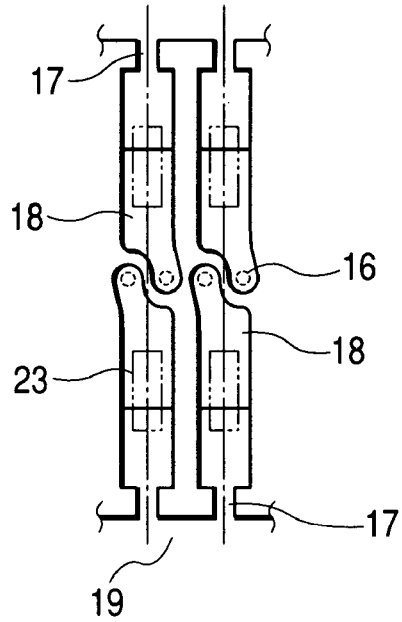
FIG. 6 is a partially enlarged view of another example of the chamber plate making up the recording head according to the invention.

FIG. 6 shows another embodiment of the invention. A communication flow passage from the pressure generating chamber 18 to the nozzle openings 16 is formed at a position slightly outside a side wall forming the pressure generating chamber 18. This has the effect of enhancing the tolerance to flow out of adhesives, for example, in bonding the nozzle plate 11. Usually, when the nozzle plate 11 and the chamber plate 12 are bonded, extrusion of adhesives occurs at least about 5 μm to 10 μm thick. Since an ink flow passage wall is very close to the nozzle openings 16, it is required to secure a space for keeping the adhesives from flowing out into the nozzle openings 16. Thus, the communication flow passage is formed to slightly extrude from the side wall of the pressure generating chamber 18, increasing the tolerance to flow out of the adhesives in the embodiment of FIG. 6.

Also, the pressure of the communication flow passage from the pressure generating chamber 18 to the nozzle openings 16 is smaller than in its central portion, because it is farther away from the center of the pressure generating chamber 18. Accordingly, the rigidity of the partition wall with adjacent nozzle openings 16 may is smaller than the rigidity of the partition wall of adjacent pressure generating chamber 18, and is designed so small as to have no influence on the characteristics. The flow passage from the pressure generating chamber 18 to the nozzle openings 16 may have an arbitrary shape, as far as it is tapered, but desirably curved in the corner portion in consideration of the exclusion of air bubble or the flowability of the ink.

The chamber plate 12 as configured in the above manner may be formed by laminating a plurality of metallic thin plates, or formed integrally with a silicone wafer by etching to further improve the precision. Moreover, the nozzle plate 11 and the chamber plate 12 may be formed integrally with the silicone wafer by etching, in which case the nozzle packaging pitch is easily increased without fear for extrusion of adhesives near the nozzles 16.

A method for packaging the recording head according to the invention will be described below, employing a line printer as an example.

Figure 7:
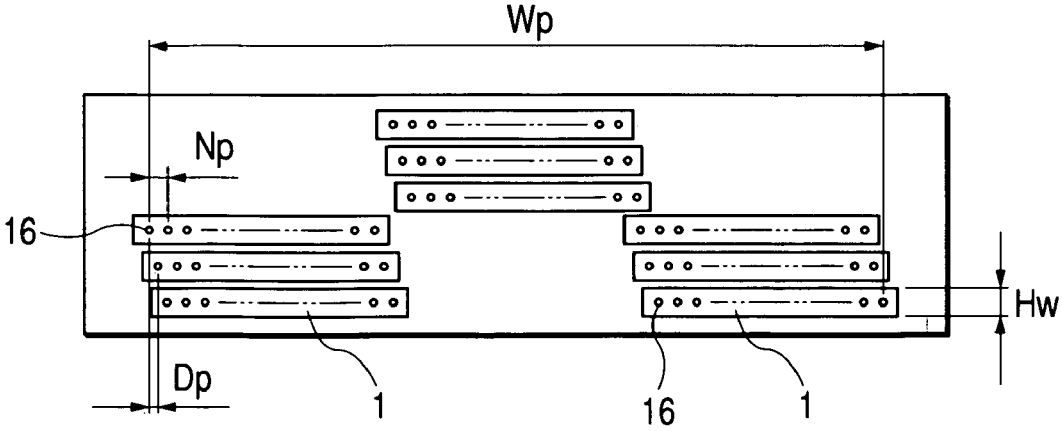
FIG. 7 is an explanatory view showing a head arrangement of the line scan recording apparatus using the recording head according to the invention.

FIG. 7 shows one example of a head arrangement of the line recording apparatus in which a plurality of heads 1 having one row of nozzles 16 are arranged linearly.

At present, the pitch Np of nozzles 16 can be at most about 180 dpi, because it is difficult to work the piezoelectric elements at narrow pitch in the head arrangement using the piezoelectric elements. When the line printing is performed with the head 1 fixed, the head set 100 is constituted in either of the ways in which the heads 1 are arranged in parallel as shown in FIG. 7 and the heads 1 are arranged obliquely as shown in FIG. 8 to attain the maximum printing density Dp.

However, the maximum printing density Dp of the recording apparatus is equal to an integral multiple of the nozzle pitch Np in one head in the packaging system, whereby it is required that the heads 1 of the number corresponding to its multiple are arranged in parallel and packaged, as shown in FIG. 7. For example, to implement Dp=300 dpi when the nozzle pitch Np is 100 dpi, it is necessary that three heads are shifted by 1/300 dpi and arranged, and packaged in staggered form by the maximum print width Wp. In this case, the width Hw size of the head 1 is designed relatively freely, but the entire head set 100 has a less excellent packaging space efficiency.

Figure 8:
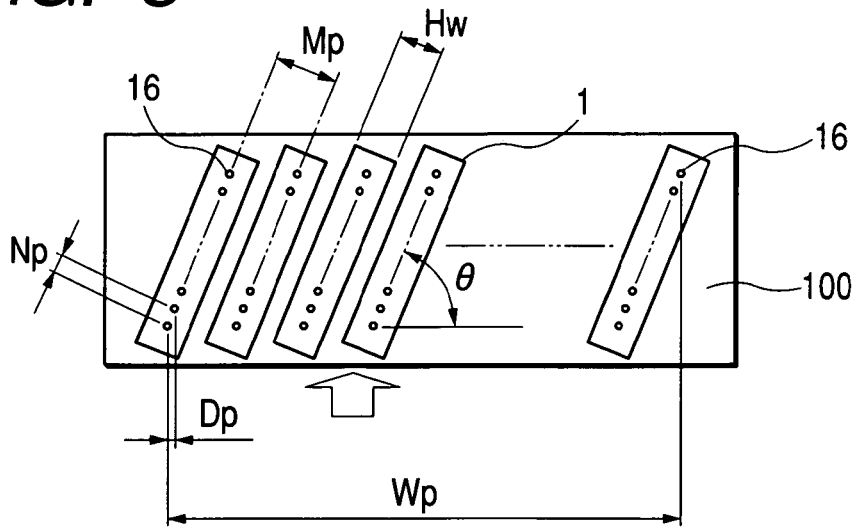
FIG. 8 is an explanatory view showing another head arrangement of the line scan recording apparatus using the recording head according to the invention.

On the other hand, when the plurality of heads 1 are packaged obliquely as shown in FIG. 8, the packaging space is more effectively utilized. However, the width Hw of head 1 that can be packaged is limited owing to the head pitch Mp that is decided from the relation between the number of nozzles and the nozzle pitch. This has the following relation.

Assume that the number of nozzles is N, the nozzle pitch is Np (npi) and the printing resolution is Dp (dpi) when the heads 1 are arranged obliquely, as shown in FIG. 8. Where the unit npi is the number of nozzles per inch (nozzle per inch), and the unit dpi is the number of dots per inch (dot per inch).

Also, the printing resolution Dp is the printing density in the sub-scan direction, or the direction (arrow direction in FIG. 8) orthogonal to the paper conveying direction, when the printing is performed using the heads 1 arranged on the line. In order to implement the required printing resolution Dp by packaging the heads 1 obliquely, first of all, the inclination angle θ of head is given by $$\theta=\mathrm{ACOS}(Np/Dp) \tag{1}$$

Also, the N-th nozzle 16 at the end portion and the directly adjacent or first nozzle 16 must be packaged at the printing resolution Dp. Accordingly, the size Mp between heads 1 packaged obliquely is decided, and it is required that the width size Hw of each head satisfies a relation Hw<Mp. Accordingly, the head width size Wh is given by $$Hw<[Mp=\mathrm{SIN}\ \theta\times\{(1/DP)\times(N-1)+1/Np\}] \tag{2}$$

For example, assuming that the number of nozzles N is 256, the nozzle pitch is 100 npi, and the printing resolution Dp is 600 dpi, the inclination angle θ of the head 1 is about 80 deg from the expression (1). From the expression (2), Hw is about 0.43 inch (about 11 mm). The nozzles 16 are packaged in one row within this width, and the ink flow passages comprising the pressure generating chambers 18 are packaged in two rows to be opposed to each other.

By deciding the head width Hw in this manner, any one of a parallel packaging method as shown in FIG. 7 and an oblique arrangement packaging method as shown in FIG. 8 can be easily employed, whereby there is a greater degree of freedom in the printing method or apparatus size. Also, the nozzles 16 are packaged near the central part of the head 1, whereby the cap design for head preservation is facilitated.

Figure 9:
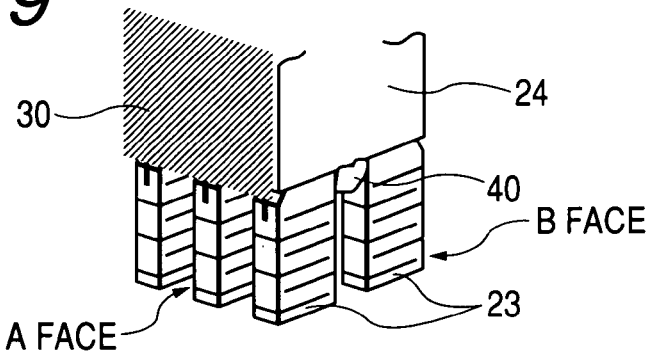
FIG. 9 is a schematic view showing one example of a group of piezoelectric elements mounted on the recording head according to the invention.

FIG. 9 is an enlarged view of the piezoelectric element group 15 of the invention as shown in FIG. 2. The working method for the piezoelectric element group is as follows.

First of all, two piezoelectric elements 23 having the piezoelectric material and the conductive material laminated like a rod are arranged at one end of the base board 24 and bonded to the base board 24. The adhesives for use may be non-conductive. Then, a conductive adhesive 40, for example, 965-1F made by Ablestik, is applied between the piezoelectric elements 23 arranged in parallel to communicate to the base board 24. This becomes a common electrode. Reference numeral 30 denotes a flexible cable serving as an individual electrode, or a so-called FPC. The side of the individual electrode (A face and B face in the figure) is not conductive to the base board 24, and fully parted.

Two piezoelectric elements 23 arranged in parallel as described above are parted like a comb by dicing techniques employing a wire saw or a grinding stone to be equal to the pitch of pressure generating chamber 18. Before parting, a surface connecting to the diaphragm 13 may be polished at the same time. In this case, the interval between the diaphragm 13 and the top end of the piezoelectric vibrator 23 in bonding with the diaphragm 13 can be even, making it possible to stabilize the characteristics.

Figure 10:
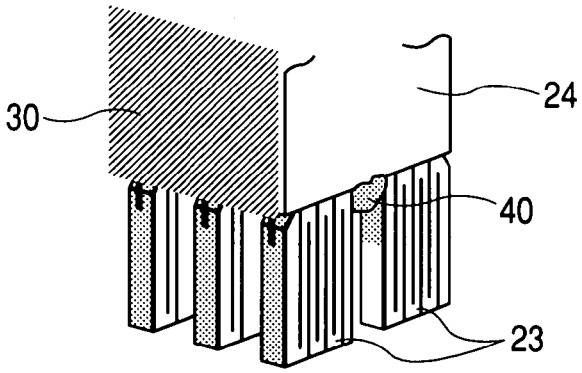
FIG. 10 is a schematic view showing another example of the group of piezoelectric elements mounted on the recording head according to the invention.

In the embodiment of FIG. 9, the piezoelectric element 23 has a structure of $d_{33}$ type in which the piezoelectric material and the conductive material are laminated on the surface parallel to the face of the base board 24, but may have a structure of $d_{31}$ type in which they are laminated in a direction perpendicular to the face of the base board 24 as shown in FIG. 10.

Figure 11:
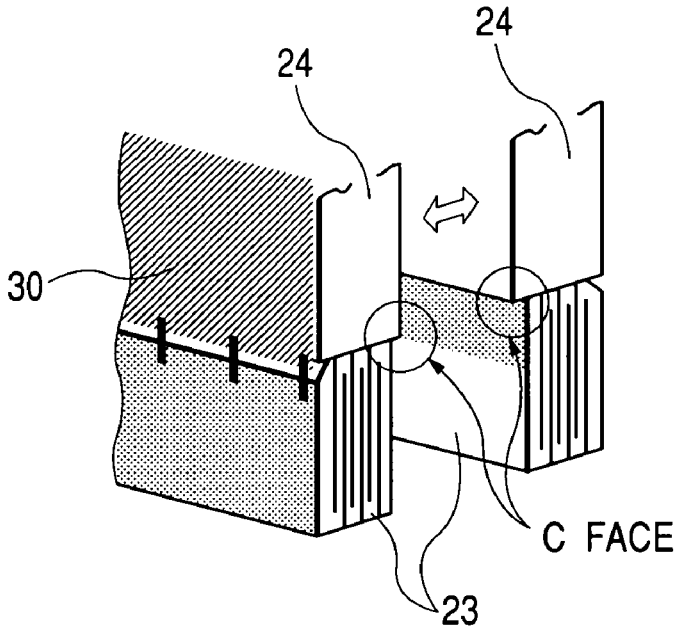
FIG. 11 is a schematic view showing another example of the group of piezoelectric elements mounted on the recording head according to the invention.

FIG. 11 shows another constitution of the piezoelectric element group 15 employed for the inkjet head 1 of the invention. First of all, the rod-like piezoelectric element 23 is secured with the base board 24 to form each piezoelectric element body. In this case, a step difference may be provided on the side of the common electrode (C face in the figure). The piezoelectric vibrator element bodies are securely bonded with the base board 24 to be opposed to each other. Thereafter, the rod-like piezoelectric element is parted to produce individual piezoelectric elements 23, as shown in FIG. 10. The base board 24 of this embodiment may be made of a combination of the conductive material and FPC. Also, an electrode maybe patterned beforehand on the base board 24, or patterned after fixing the piezoelectric element 23.

Also, the base board 24 for fixing the piezoelectric element 23 may be firmly fixed with the housing, but may not be firmly fixed, if the Young's modulus and specific gravity of the base board 24 are greater than those of the piezoelectric element 23, and the entire mass is large, because the base board 24 can fully withstand a reaction to a displacement of the piezoelectric element 23. Accordingly, the working precision of a hole portion of the housing for inserting the piezoelectric element group 15 may be relatively rough.

As described above, with the invention, the inkjet recording head has a narrower interval between the pressure generating chambers, because the pressure generating chambers are disposed on both sides of the row of nozzles for discharging ink droplets in a positional relation in which the central lines of the pressure generating chambers opposed are almost coincident, whereby the high density packaging is facilitated. Also, the piezoelectric vibrators arranged at opposite positions are improved in the workability, whereby the head is assembled at high precision. Furthermore, the piezoelectric vibrators integrally constructed are easily inserted through a hole of the housing with the ink flow passage board fixed, whereby the misregistration of the piezoelectric vibrators relative to the opposed pressure generating chambers is reduced and the discharge variation is reduced.

Also, since the packaging density of pressure chambers is half the packaging density of nozzles, the relatively large volume of pressure generating chamber is secured. Therefore, it is possible to fly larger ink droplets as compared with the conventional head having the same nozzle packaging density, whereby the recording apparatus capable of flying ink droplets in a broader range is provided.

Also, since the width of head is made corresponding to the maximum printing resolution, the tolerance in packaging the head is increased, making it possible to design the inkjet printer with a higher degree of freedom. Furthermore, since the position of nozzle is designed near the center of the head, the cap for protecting the head is easily designed, and the head maintenance is facilitated, whereby the inkjet recording apparatus with high reliability is provided.

What is claimed is:

1. A recording head, comprising:

a nozzle plate having nozzles for discharging ink droplets arranged in a row;

a plurality of pressure generating chambers communicating to the nozzles, the plurality of pressure generating chambers including a first pressure generating chamber and a second pressure generating chamber;

a diaphragm formed on one face of the pressure generating chamber;

a piezoelectric element for displacing the diaphragm, wherein the first pressure generating chamber is disposed on one side of the nozzles arranged in the row, and the second pressure generating chamber is disposed on the other side, and the first and second pressure generating chambers are opposed to each other across the nozzles arranged in the row so that central lines of the first and second pressure generating chambers are almost coincident; and a communication flow passage leading from the plurality of pressure generating chambers to the nozzles, wherein a width of one of the first and second pressure generating chambers is defined by two side wall faces, and wherein a portion of the communication flow passage is located outside the width of one of the first and second pressure generating chambers.

2. The inkjet recording head according to claim 1, wherein Cp is chosen to be about double Np, where a distance between the central lines of the first and second pressure generating chambers is Cp and the distance between the nozzles is Np.

3. The inkjet recording head according to claim 1, wherein the piezoelectric element has a piezoelectric material and an electrically conductive material laminated alternately, and wherein one end of the piezoelectric element is fixed to at least one base board having electrical conductivity.

4. The inkjet recording head according to claim 1, wherein the piezoelectric element is fixed to a base board and is divided like a comb.

5. The inkjet recording head according to claim 1, wherein the plurality of pressure generating chambers are formed of silicon by etching.

6. A recording head comprising:

a nozzle plate having nozzles for discharging ink droplets arranged in a row;

a plurality of pressure generating chambers communicating to the nozzles, the plurality of pressure generating chambers including a first pressure generating chamber and a second pressure generating chamber;

a diaphragm formed on one face of the pressure generating chamber; and a piezoelectric element for displacing the diaphragm, wherein the first pressure generating chamber is disposed on one side of the nozzles arranged in the row, and the second pressure generating chamber is disposed on the other side, wherein the first and second pressure generating chambers are opposed to each other across the nozzles arranged in the row so that central lines of the first and second pressure generating chambers are almost coincident, and wherein a rigidity of a partition wall between the adjacent nozzles and a communication flow passage is smaller than a rigidity of a partition wall between the adjacent one of the first and second pressure generating chambers.

7. The inkjet recording head according to claim 6, wherein Cp is chosen to be about double Np, where a distance between the central lines of the first and second pressure generating chambers is Cp and the distance between the nozzles is Np.

8. The inkjet recording head according to claim 6, wherein the piezoelectric element includes a piezoelectric material and an electrically conductive material laminated alternately, and one end of the piezoelectric element is fixed to at least one base board having electrical conductivity.

9. The inkjet recording head according to claim 6, wherein the piezoelectric element is fixed to a base board and is divided like a comb.

10. The inkjet recording head according to claim 6, wherein the plurality of pressure generating chambers are formed of silicon by etching.

11. A recording head comprising:

a nozzle plate having nozzles for discharging ink droplets arranged in a row;

a plurality of pressure generating chambers communicating to the nozzles, the plurality of pressure generating chambers including a first pressure generating chamber and a second pressure generating chamber;

a diaphragm formed on one face of the pressure generating chamber; and a piezoelectric element for displacing the diaphragm;

wherein the first pressure generating chamber is disposed on one side of the nozzles arranged in the row, and the second pressure generating chamber is disposed on the other side, and the first and second pressure generating chambers are opposed to each other across the nozzles arranged in the row so that central lines of the first and second pressure generating chambers are almost coincident, wherein the inkjet recording head comprises a line scan head which has the nozzles arranged in the row and which is fixed while a printing is performed, and wherein a total number of nozzles N, a distance between nozzles Np (inch), a printing resolution Dp (dots/inch), and a width of the line scan head Wh (inch) satisfy following formula:

$$Wh < \mathrm{SIN}\ \{\mathrm{A\ COS}(Np/Dp)\} \times \{(1/Dp) \times (N-1) + 1/Np\}.$$

12. The inkjet recording head according to claim 11, wherein Cp is chosen to be about double Np, where a distance between the central lines of the first and second pressure generating chambers is Cp and the distance between the nozzles is Np.

13. The inkjet recording head according to claim 11, wherein the piezoelectric element has a piezoelectric material and an electrically conductive material laminated alternately, and wherein one end of the piezoelectric element is fixed to at least one base board having electrical conductivity.

14. The inkjet recording head according to claim 11, wherein the piezoelectric element is fixed to a base board and is divided like a comb.

15. The inkjet recording head according to claim 11, wherein the plurality of pressure generating chambers are formed of silicon by etching.

16. A inkjet recording apparatus comprising:

a nozzle plate having nozzles for discharging ink droplets arranged in a row;

a plurality of pressure generating chambers communicating to the nozzles, the plurality of pressure generating chambers including a first pressure generating chamber and a second pressure generating chamber;

a diaphragm formed on one face of the plurality of pressure generating chambers;

a common ink chamber for supplying the ink via an ink supply passage to the plurality of pressure generating chambers; and a piezoelectric element for displacing the diaphragm, wherein the first pressure generating chamber is disposed on one side of the nozzles arranged in the row, and the second pressure generating chamber is disposed on the other side, wherein the first and second pressure generating chambers are opposed to each other across the nozzles arranged in the row so that central lines of the first and second pressure generating chambers are almost coincident, wherein the nozzle plate, the plurality of pressure generating chambers, the diaphragm, the common ink chamber and the piezoelectric element is accommodated by a line scan head that is fixed while a printing is performed, and wherein a total number of nozzles N, a distance between nozzles Np (inch), a printing resolution Dp (dots/inch), and a width of the line scan head Wh (inch) satisfy following formula:

$$Wh < \mathrm{SIN}\ \{\mathrm{A\ COS}(Np/Dp)\} \times \{(1/Dp) \times (N-1) + 1/Np\}.$$

* * * * *